US005147190A

United States Patent [19]

Hovarter

[11] Patent Number: 5,147,190

[45] Date of Patent: Sep. 15, 1992

[54] INCREASED EFFICIENCY VALVE SYSTEM FOR A FLUID PUMPING ASSEMBLY

[75] Inventor: Len A. Hovarter, Eaton Rapids, Mich.

[73] Assignee: General Motors Corporation, Detroit, Mich.

[21] Appl. No.: 717,571

[22] Filed: Jun. 19, 1991

[51] Int. Cl.[5] ..... F04B 21/02

[52] U.S. Cl. ..... 417/571; 417/269; 417/222.1

[58] Field of Search ..... 417/571, 269, 222 R

[56] References Cited

U.S. PATENT DOCUMENTS

| | | | |
|---|---|---|---|
| 2,193,123 | 3/1940 | Des Roches | 417/571 |
| 2,215,017 | 9/1940 | Schmitt | 417/571 |
| 2,935,248 | 5/1960 | Gerteis | 417/571 |
| 3,817,660 | 6/1974 | Knowles | 417/269 |
| 4,351,227 | 9/1982 | Copp, Jr. et al. | 92/71 |
| 4,642,037 | 2/1987 | Fritchman | 417/571 |
| 4,749,340 | 6/1988 | Ikeda et al. | 417/269 |
| 4,764,091 | 8/1988 | Ikeda et al. | 417/269 |
| 4,778,360 | 10/1988 | Ikeda et al. | 417/571 |
| 4,781,540 | 11/1988 | Ikeda et al. | 417/571 |
| 4,790,727 | 12/1988 | Steele | 417/269 |
| 4,854,839 | 8/1989 | DiFlora | 417/571 |
| 4,867,650 | 9/1989 | Ikeda et al. | 417/269 |
| 4,911,614 | 3/1990 | Kawai et al. | 417/269 |
| 4,976,284 | 4/1990 | Hovarter | 417/269 |

FOREIGN PATENT DOCUMENTS

| | | | |
|---|---|---|---|
| 224475 | 11/1962 | Fed. Rep. of Germany | 417/571 |
| 2161583 | 1/1986 | United Kingdom . | |

*Primary Examiner*—Richard A. Bertsch
*Assistant Examiner*—Peter Korytnyk
*Attorney, Agent, or Firm*—Ronald L. Phillips

[57] ABSTRACT

A valve system for a fluid pumping assembly including a valve plate having at least one intake port extending therethrough and at least one discharge port also extending therethrough. The discharge port includes a central axis extending through the discharge port and orthoginal to the valve plate. The intake port is a slot having a width less than its length and subscribing an arc radially spaced from the central axis of the discharge port. A suction reed valve has a valve member that is defined at its distal edge by an arcuate slot in the valve wherein the slot is disposed arcuately and radially spaced from a discharge aperture in the valve member and terminates at either end in inwardly extending lobe portions that define a neck portion in the valve member having an axis about which the valve member moves between open and closed positions.

4 Claims, 2 Drawing Sheets

INCREASED EFFICIENCY VALVE SYSTEM FOR A FLUID PUMPING ASSEMBLY

BACKGROUND OF THE INVENTION

1. Technical Field

The subject invention is directed toward an increased efficiency valve system for a fluid pumping assembly wherein the suction and discharge ports in a valve plate have a specific configuration and disposition relative to one another to optimize the volumetric efficiency of a fluid pumping assembly.

2. Description of the Prior Art

Fluid pumping assemblies of the prior art, such as refrigerant compressors, typically employ reed valve systems for opening and closing intake and exhaust ports in the valve plate thereby controlling the ingress of refrigerant vapor from a suction chamber into a compression chamber under a predetermined lower pressure and the egress of the compressed vapor through the discharge port and into a discharge cavity at a predetermined elevated pressure.

More specifically, and with reference to the fragmented cross-sectional side view of FIG. 1, a portion of a prior art fluid pumping assembly is shown, generally at 10, and includes a cylinder block 12, a head 14 fixedly attached to the cylinder block 12 with a valve plate 16 disposed between the cylinder block 12 and head 14. The cylinder block 12 includes a cylinder insert 18 fixedly disposed therein and which defines a compression chamber 20. The head 14 includes a suction chamber 22 and a discharge chamber 24. The discharge chamber 24 is in fluid communication with the compression chamber 20 via an outlet port (not shown) when the one way discharge flapper valve 26 is moved to its open position. Discharge flapper valves 26 of the prior art generally work in conjunction with a back stop 28 which serves to limit the distance a discharge valve can flex in response to the elevated pressures developed in the compression chamber 20 during the compression stroke of a piston 27.

A suction chamber 22 is in fluid communication with the compression chamber 20 via an inlet port 30 when the one way inlet suction reed valve member 32 is moved to its open position. Suction reed valve members 32 are typically made of thin plates of spring steel and are designed to flex away from the inlet port under certain predetermined minimum pressures. However, in order to limit the amount of flex (and therefore stress) to which a reed valve member 32 is subjected and thereby increasing its working life, prior art valve systems employ thumb nails 34 which can be defined by shoulders presented in the compression chambers 22 by the cylinders 18. However, thumb nails 34 have become increasingly undesirable because an unacceptable level of noise is generated when the suction reed valve member 32 comes into abutting contact with the thumb nail 34 during the intake stroke of a piston 27.

Furthermore, one of the design objectives for fluid pumping assemblies is to increase the volumetric efficiency of the assembly. One way this can be achieved is by increasing the size of the inlet and outlet ports. However, such solutions are limited by the finite area of the valve plate subscribed by the cross section of the individual cylinders 18 and the stresses induced on the valve plate when more material is removed to enlarge the ports. There is only so much space in a valve plate within the limited confines of a cross section of the cylinder in which to position enlarged inlet and outlet ports while attempting to maintain the structural integrity of the valve plate. Optimum intake port size must be balanced with the fact that the thin metallic suction reed valves can be deformed into the inlet ports under the influence of the elevated pressures generated in the compression chambers during the piston compression stroke. Such deformation in the reed valves create "oil can" stresses in the suction reed valve which can reduce working life and lead to premature failure of the reed valve.

As such, it has always been a design objective to optimize volumetric flow efficiency while maintaining the structural integrity of the valve system. Prior art valve systems have attempted to do this with varying degrees of complexity and varying degrees of success.

SUMMARY OF THE INVENTION AND ADVANTAGES

The subject invention is directed toward a valve system which optimize volumetric flow efficiency in a fluid pumping assembly while efficiently using the space available in the valve plate to do so and while at the same time eliminating "oil can" stresses in the suction reed valve member. More specifically, the subject invention is directed toward a valve system for a fluid pumping assembly having a cylinder block including compression chambers defined therein and a head operatively fastened to the cylinder block. The head defines suction and discharge chambers. A valve plate is disposed between the cylinder block and the head and includes at least one intake port extending therethrough and providing fluid communication between the compression chamber and the suction chamber. The valve plate further includes at least one discharge port extending therethrough and providing fluid communication between the compression chamber and the discharge chamber. The discharge port includes a central axis extending therethrough and orthoginal to the valve plate. The intake port is defined by a slot having a width less than its length and subscribing an arc radially spaced from the central axis of the discharge port. A suction reed valve is disposed adjacent the valve plate and has a valve member overlying the intake port and moveable between an open position for allowing fluid flow through the intake port and between the suction and compression chambers and a closed position for preventing fluid flow through the intake port. The reed valve member includes a discharge aperture disposed adjacent the discharge port of the valve plate for allowing continuous fluid flow to the discharge port. The reed valve member is defined at its distal edge by an arcuate slot in the suction reed valve. The slot is disposed arcuately and radially spaced from the discharge aperture and terminates at either end in inwardly extending lobe portions which define a neck portion in the valve member extending between the lobe portions and having an axis about which the reed valve member substantially moves between its open and closed positions.

The specific configuration of the inlet and outlet ports in the valve plate of the subject invention solves the aforementioned problems of the prior art in a cost effective manner by providing optimum volumetric flow rate without jeopardizing the structural integrity of the valve plate and without inducing "oil can" stresses in the reed valve member during the compression stroke of the piston. Furthermore, the design of the reed valve member of the subject invention obviates the need for thumb nails to limit the amount of flex of the reed valve during the intake stroke of the piston.

DESCRIPTION OF THE PREFERRED EMBODIMENT

Figure 2:
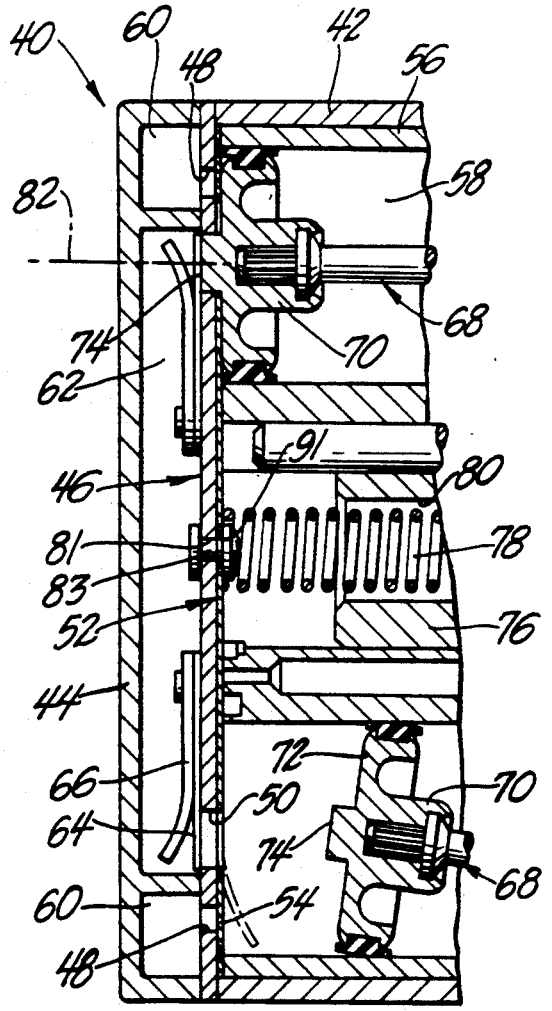
FIG. 2 is a fragmentary cross-sectional side view of a fluid pumping assembly employing the valve system of the subject invention.
Figure 1:
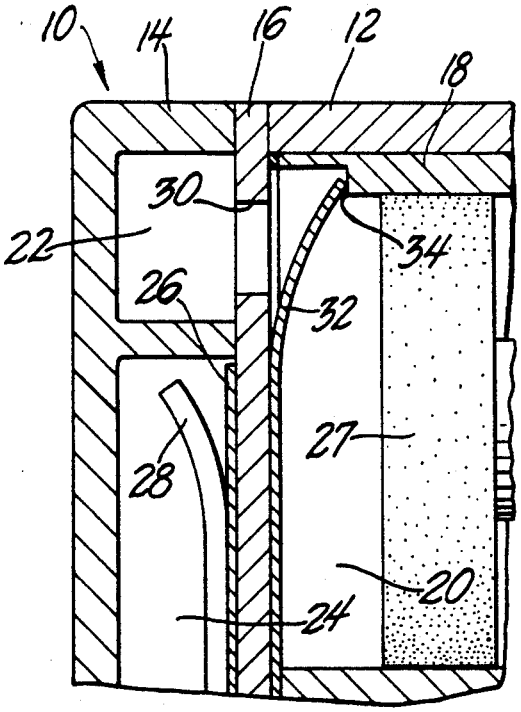
PRIOR ART Fig. 1
FIG. 1 is a fragmentary cross-sectional side view of a fluid pumping assembly employing a valve system of the prior art.
Figure 3:
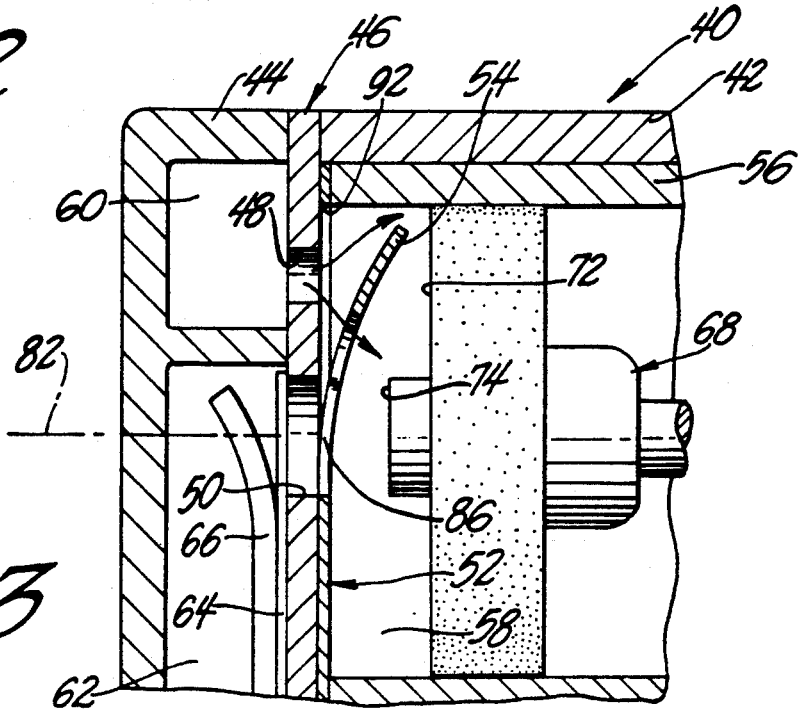
FIG. 3 is a cross-sectional side view illustrating the valve system of the subject invention during the intake stroke of a piston.

The subject invention is directed toward a valve system for a fluid pumping assembly which is generally shown in partial cross-sectional side view at 40 in FIGS. 2 and 3. More specifically, the valve system of the subject invention will be described in conjunction with a compressor assembly 40 of the type for compressing a recirculated refrigerant fluid in the air conditioning system of an automobile. The compression assembly 40 includes a cylinder block 42, a head 44 fixedly attached to the cylinder block 42 with a substantially circular valve plate, generally indicated at 46, disposed between the cylinder block 42 and the head 44 at the radial edge. The valve plate 46 includes at least one intake port 48 extending therethrough and at least one discharge port 50 extending therethrough. A substantially circular suction reed valve, generally indicated at 52, is disposed adjacent the valve plate 46, and between the cylinder block 42 and the head 44. The suction reed valve 52 includes a valve member 54 overlaying the intake port 48 and moveable between an open position, as shown in FIG. 3, for allowing fluid flow through the intake port 48 and a closed position for preventing fluid flow through the intake port 48. The cylinder block 42 includes a cylinder insert 56 fixedly disposed therein and which defines a compression chamber 58. The head 44 includes a suction chamber 60 and a discharge chamber 62.

The discharge chamber 62 is in fluid communication with the compression chamber 58 via the discharge port 50 when the one way discharge flapper valve 64 is moved to its open position. The discharge flapper valve 64 works in conjunction with a back stop 66 which serves to limit the distance the discharge valve 64 can flex in response to the elevated pressures developed in the compression chamber 58 during the compression stroke of a piston 68. The suction chamber 60 is in fluid communication with the compression chamber 58 via intake port 48 when the one way suction reed valve member 54 is moved to its open position.

The piston assembly, generally indicated at 68, reciprocates between intake and exhaust positions within the compression chamber 58 as shown in FIG. 2. The piston assembly 68 includes a piston head 70 having a working surface 72 for compressing the fluid disposed within the compression chamber 58. The working surface 72 includes a protrusion 74 adapted to be received by the discharge port 50 when the piston 68 is in the exhaust position such that the discharge port 50 volume is swept thereby increasing the efficiency of the compressor assembly 40. More specifically, the protrusion 74 has a shape corresponding to the shape of the discharge port 50 and is snugly received by the discharge port 50 when the piston assembly 68 is moved to the exhaust position.

The compressor 40 further includes a centrally disposed shaft 76 about which a wobble plate (not shown) may be mounted to reciprocate the pistons 68 in the cylinder 56, as is commonly known in the art. The shaft 76 is nonrotatable but is axially adjustable in the cylinder block 42 in response to pressure differentials existing between the cylinder block 42 and the discharge chamber 62 to adjust the stroke of the piston 68 thereby varying the capacity of the compressor 40 as is commonly known in the art. To this end, the compressor 40 includes a biasing means 78 in the form of a coiled spring which is disposed between a cavity 80 in the shaft 76 and the valve plate 46 and is calibrated to be responsive to the aforementioned pressure differentials. Alternatively, the valve system of the subject invention may be employed in a swash plate type compressor or any other fluid pumping assembly employing reed valves with equal success.

Figure 5:
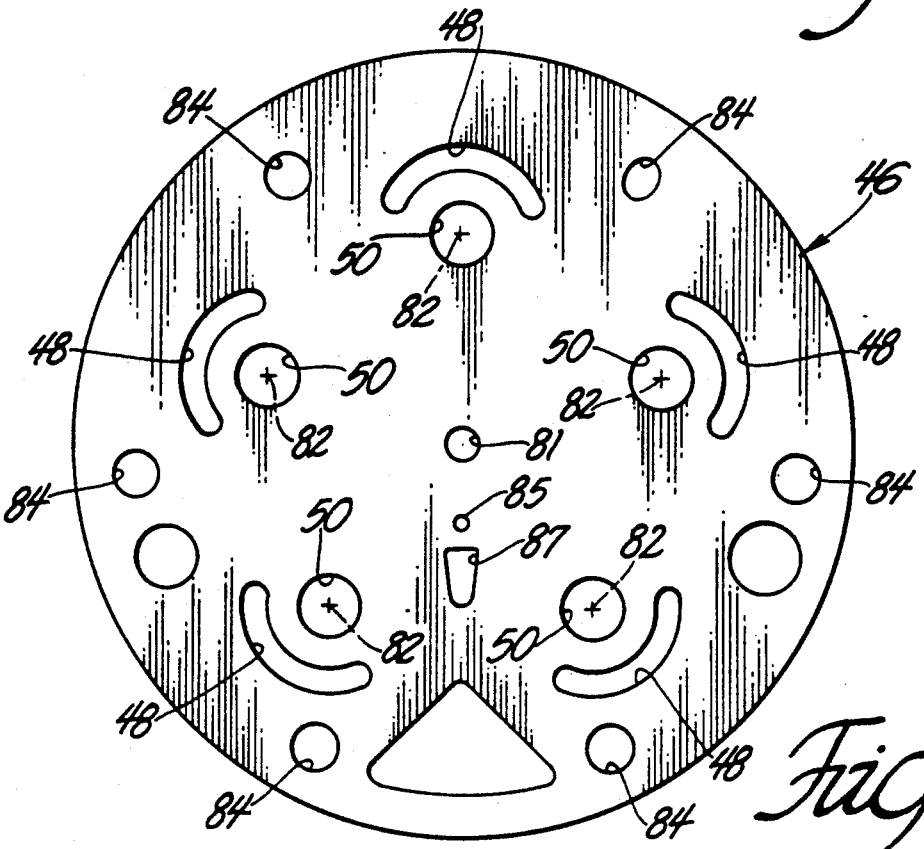
FIG. 5 is a top plan view of the valve plate of the subject invention.

As best shown in FIG. 5, the discharge port 50 of the valve plate 46 of the subject invention includes a central axis 82 extending therethrough and orthoginal to the valve plate 46. The intake port 48 is a slot having a width less than its length and subscribing an arc radially spaced from the central axis 82 of the discharge port 50. More specifically, the intake port 48 is a semicircular arc. The discharge port 50 is substantially circular in shape with the orthoginal central axis 82 extending through the center of the discharge port 50. Furthermore, the center of the circular discharge port 50 is also the center of an imaginary circle having an arc defined by the intake port 48.

A mounting hole 81 is disposed centrally in the valve plate 46 and accommodates a rivet 83 best shown in FIG. 2 to mount the reed valve 52 on the valve plate 46. The valve plate 46 further includes six bolt holes 84 disposed about the periphery of the valve plate and which accommodate fasteners, such as bolts (not shown), employed for holding the compressor together. Ports 85 and 87 are disposed slightly off center in the annular valve plate 46 and are utilized in conjunction with control passages communicating between the cylinder block 42 and the discharge chamber 62 for adjusting the centrally disposed shaft 76 thereby varying the capacity of the compressor 10 as discussed above.

The semicircular arcuate intake port 48 provides for maximum suction port area while preventing "oil can" stresses in the suction reed valve member 54. In contradistinction, circular intake ports having the same cross-sectional area will induce "oil can" stresses in suction reed valve members and thereby contribute to their failure. Furthermore, in addition to maximizing the cross-sectional area of the intake port, the arcuate semicircular shape thereof facilitates the substantially central location of the discharge port 50 while at the same time maximizing its cross-sectional area. In this way, the volumetric flow efficiency of a compressor employing the valve plate of the subject invention is increased while at the same time maintaining the structural integrity of the valve plate and avoiding other problems in the prior art as discussed above.

Figure 4:
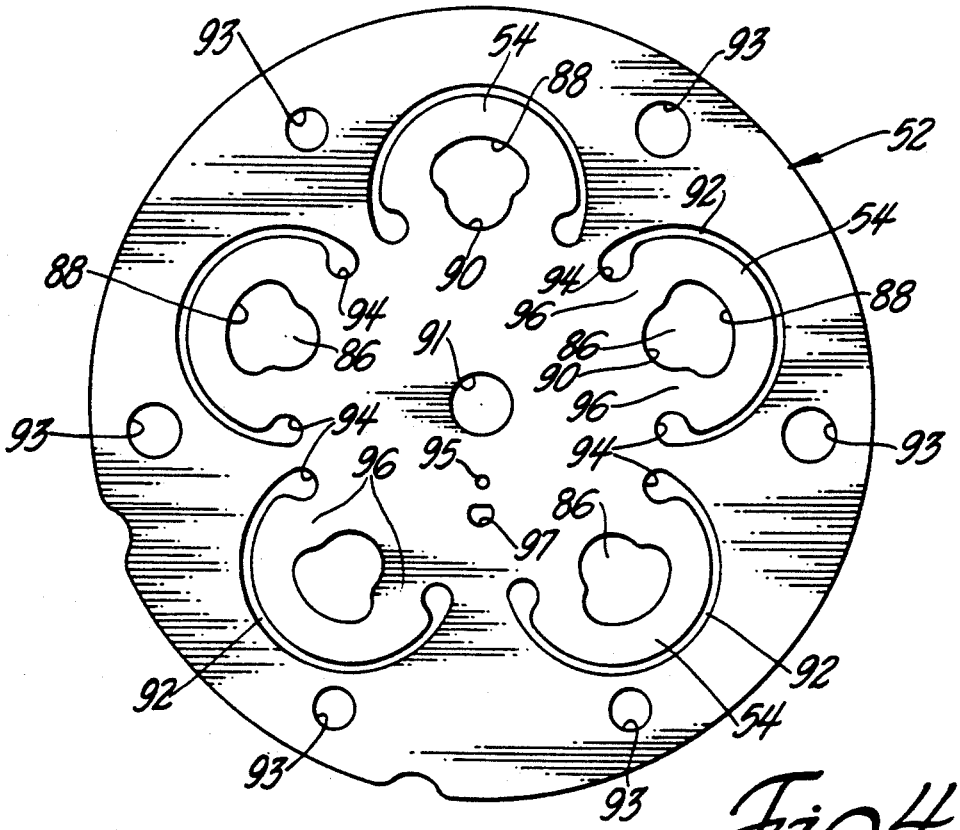
FIG. 4 is a top plan view of the suction reed valve of the subject invention.

As shown in FIG. 4, the valve member 54 of the suction reed valve 52 of the subject invention includes a discharge aperture 86 disposed adjacent the discharge port 50 of the valve plate 46 for allowing continuous fluid flow to one side of the discharge port 50. As the discharge port 50 is closed by the discharge flapper valve 64 during the intake stroke of the piston 68, no fluid escapes the compression chamber 58. However, during the exhaust stroke of a piston 68 and once sufficient pressure has built in the compression chamber 58, the discharge flapper valve 64 will be moved to its open position allowing fluid flow through the discharge apertures 86 in the valve member 54 and the discharge port 50 in the valve plate 46 and into the discharge chamber 62. The discharge aperture 86 may be substantially circular in shape and may have the substantially same or slightly greater cross-sectional area than the discharge port 50. Alternatively, the discharge aperture 86 may be defined by first and second arcuate lobe portions 88, 90, respectively, as shown in FIG. 4. In this case and with the preferred embodiment, the first lobe portion 88 has a radius greater than the radius defining the second arcuate lobe portion 90. In either case, the discharge aperture 86, as well as the discharge port 50 is adapted to receive the protrusion 74 disposed on the working surface 72 of the piston 68.

The valve member 54 is defined at its distal edge by an arcuate slot 92 in the suction reed valve 52. The slot 92 is disposed arcuately and radially spaced from the discharge aperture 86 and terminates at both of its ends in inwardly extending lobe portions 94 which define a neck portion 96 in the valve member 54. The neck portion 96 extends between the lobe portions 94 and has an axis about which the valve member 54 substantially moves between open and closed positions. More specifically, and as shown in FIG. 4, the suction reed valve member 52 is a plate made of thin spring steel including a plurality of discharge apertures 86 all having corresponding arcuate slots 92 to define the valve members 54. Each discharge aperture 86 and valve member 54 defined by the arcuate slot 92 is associated with a discharge port 50 and arcuate intake port 48. It has been determined using finite element analysis, that the inwardly extending lobe portions 94 which define the neck portion 96 produce the least amount of stress across the neck portion 96 when the valve member is flexed between open and closed positions.

As indicated above, the intake port 48 is sealed from the compression chamber 58 when a valve member 54 is disposed over the intake port 48 and in its closed position. When the valve member 54 is moved to its open position, fluid communication is provided between the suction and compression chambers, 60, 58 respectively, through the intake port 48, past the arcuate slot 92 defining the valve member 54 as well as past the discharge aperture 86 which provides another path for the fluid into the compression chamber 58.

As with the valve plate 46, the suction reed valve 52 similarly includes a mounting hole 91 disposed centrally in the reed valve 52 and which also accommodates the rivet 83 as best shown in FIG. 2 to mount the reed valve 52 in the compressor 10. The suction reed valve 52 also includes six bolt holes 93 disposed about the periphery of the reed valve 52 to accommodate fasteners, such as bolts (not shown), employed for holding the compressor together. Ports 95 and 97 are disposed slightly off center in this annular reed valve 52 and are utilized in conjunction with control passages communicating between the cylinder block 42 and the discharge chamber 62 for adjusting the centrally disposed shaft 76 thereby varying the capacity of the compressor as discussed above.

The invention has been described in an illustrative manner and it is to be understood that the terminology which has been used is intended to be in the nature of words of description rather than limitation. Obviously, many modifications and variations of the present invention are possible in light of the above teachings. It is, therefore, to be understood that within the scope of the appended claims, the invention may be practiced otherwise than as specifically described.

What I claim is:

1. A valve system for a fluid pumping assembly, said system comprising;

a valve plate including at least one intake port extending therethrough and at least one discharge port extending therethrough;

a suction reed valve disposed adjacent said valve plate and having a valve member overlaying said intake port and moveable between an open position for allowing fluid flow through said intake port and a closed position for preventing fluid flow through said intake port;

said valve member including a discharge aperture disposed adjacent said discharge port of said valve plate and allowing continuous fluid flow to said discharge port;

said valve member defined at its distal edge by an arcuate slot in said suction reed valve, said slot being disposed arcuately and radially spaced from said discharge aperture and terminating at either end in inwardly extending lobe portions which define a neck portion in said valve member extending between said lobe portions and having an axis about which said valve member substantially moves between said open and closed positions.

2. A valve system as set forth in claim 1 further characterized by said discharge aperture being substantially circular in shape.

3. A valve system as set forth in claim 1 further characterized by said discharge aperture being defined by first and second arcuate lobe portions, said first lobe portion having a radius greater than the radius defining said second arcuate lobe portion.

4. A compressor assembly of the type for compressing a recirculated refrigerant fluid, said assembly comprising;

a cylinder block including a compression chamber and a head operatively fastened to said cylinder block and including suction and discharge chambers;

a valve plate disposed between said cylinder block and said head and including at least one intake port extending therethrough and providing fluid communication between said compression chamber and said suction chamber and including at least one discharge port extending therethrough and providing fluid communication between said compression chamber and said discharge chamber;

said discharge port including a central axis extending therethrough and orthoginal to said valve plate, said intake port being a slot having a width less than its length and subscribing an arc radially spaced from said central axis of said discharge port;

a suction reed valve disposed adjacent said valve plate and having a valve member overlaying said intake port and movable between an open position for allowing fluid flow through said intake port and between said suction and compression chambers and a closed position for preventing fluid flow through said intake port;

said valve member including a discharge aperture disposed adjacent said discharge port of said valve plate for allowing continuous fluid flow to said discharge port;

said valve member defined at its distal edge by an arcuate slot in said suction reed valve, said slot being disposed arcuately and radially spaced from said discharge aperture and terminating at either end in inwardly extending lobe portions which define a neck portion in said valve member extending between said lobe portions and having an axis about which said valve member substantially moves between said open and closed positions.

* * * * *